US005341737A

United States Patent [19]

Marozzi et al.

[11] Patent Number: 5,341,737

[45] Date of Patent: Aug. 30, 1994

[54] FLEXOGRAPHIC PRINTING SYSTEM

[75] Inventors: John Marozzi, 634 Dogwood La., Booton Township, Morris County, N.J. 07950; Greg Rochon, Boonton; Urmil Patel, Somerville, both of N.J.; Ben Dambly, York, Pa.

[73] Assignees: John Marozzi, Boonton Township, Morris County; Theresa Pugh, Parsippany; Barbara Batesko, Montville, all of N.J.

[21] Appl. No.: 43,925

[22] Filed: Apr. 8, 1993

Related U.S. Application Data

[62] Division of Ser. No. 852,531, Mar. 17, 1992, Pat. No. 5,224,422.

[51] Int. Cl.[5] ..... B41F 5/04; B41F 5/24

[52] U.S. Cl. ..... 101/216; 101/415.1

[58] Field of Search ..... 101/216, 219, 228, 375, 101/376, 415.1, 378, 136, 138

[56] References Cited

U.S. PATENT DOCUMENTS

| | | | |
|---|---|---|---|
| 1,107,512 | 8/1914 | Gardner . | |
| 1,391,117 | 9/1921 | Huebner . | |
| 1,747,963 | 2/1930 | Wichman | 101/375 X |
| 2,056,205 | 10/1936 | O'Hara . | |
| 2,603,153 | 7/1952 | Warren | 101/219 |
| 2,607,293 | 8/1952 | McKay | 101/376 |
| 3,017,830 | 1/1962 | Penner . | |
| 3,107,609 | 10/1963 | Haramija . | |
| 3,128,700 | 4/1964 | Kunetka | 101/376 X |
| 3,138,098 | 6/1964 | Worth | 101/235 X |
| 3,202,098 | 8/1965 | Keeler . | |
| 3,203,346 | 8/1965 | Norton et al. . | |
| 3,260,193 | 7/1966 | Mann | 101/235 |
| 3,373,684 | 3/1968 | Fisher | 101/228 |
| 3,424,085 | 1/1969 | Beisel . | |
| 3,457,854 | 7/1969 | Marozzi . | |
| 3,487,776 | 1/1970 | Marozzi . | |
| 3,537,393 | 11/1970 | Hegi | 101/235 |
| 3,583,318 | 6/1971 | Stevenson . | |
| 3,662,682 | 5/1972 | Marozzi . | |
| 3,696,744 | 10/1972 | Etchell . | |
| 3,797,390 | 3/1974 | Marozzi et al. . | |
| 3,804,016 | 4/1974 | Marozzi et al. . | |
| 3,892,179 | 7/1975 | Jahn | 101/415.1 |
| 4,145,967 | 3/1979 | Marozzi . | |
| 4,760,788 | 8/1988 | Marozzi et al. . | |

FOREIGN PATENT DOCUMENTS

| | | | |
|---|---|---|---|
| 1036374 | 9/1953 | France | 101/415.1 |
| 1071688 | 6/1967 | United Kingdom . | |

*Primary Examiner*—J. Reed Fisher

*Attorney, Agent, or Firm*—Jacobson, Price, Holman & Stern

[57] ABSTRACT

A flexographic printing system using mechanical and friction drive at the same time. The print cylinder is rotated by a friction drive only while printing (during the print cycle). The print cylinder is rotated past the anilox roll (during the inking cycle), and the print cylinder is reset to the start position ready for the next printing cycle by a mechanical drive. The print cylinder is preferably less than 360 degrees around, and most preferably measures only 170 degrees around. The print cylinder is made from plastic. Printing plates are premounted permanently to a mylar carrier sheet that is designed with pin and hook holes that line up with pins and hooks that are part of the print cylinder. These plates have drive bearers as part of the mylar carrier sheet. The ink management system circulates the ink, cleans the entire ink system, and separates the ink from the waste and the cleaner. It also measures the pH of the ink or the viscosity level of the ink and automatically adds pH adjuster or thinner.

11 Claims, 10 Drawing Sheets

FLEXOGRAPHIC PRINTING SYSTEM

This is a Divisional of application Ser. No. 07/852,531, filed Mar. 17, 1992, now U.S. Pat. No. 5,224,422.

FIELD OF THE INVENTION

The present invention is a single color, rotary, flexographic printer used in conjunction with a variety of packaging machines for printing any information on a packaging web. Typical applications include: product descriptions, identification, uses, codes, lot numbers, company logos, and bar codes. The need for buying preprinted webs is eliminated by the present invention.

BACKGROUND OF THE INVENTION

Typically, printing of a web for a horizontal form-fill packaging machine has included a platen press. Printing of the packaging web could be accomplished at a speed of 12–15 imprints per minute. The relatively slow speed involved was required to obtain proper alignment of the press with the moving web and the requirement for an even printing contact of the platen press with the web. Characteristically, the resultant printed web was of a poor quality.

Further, due to the long dwell time of the ink on the printing plate between impressions, a slow-drying ink was required. The slow-drying ink limited the characteristics of the web used, typically limiting the web to an absorbent film, such as a paper web, which could absorb the slow-drying ink. This, however, precluded the use of a platen press on non-absorbent film or foil which required quick-drying ink which would dry by evaporation only.

A proposed solution to overcoming the difficulties encountered by the use of platen presses has been the use of flexographic printers using a liquid ink as compared to a paste ink typically associated with platen presses. Traditional flexographic printers are driven entirely mechanically through a single drive system. A standard fixed speed DC motor is used and elaborate controls required to match the speed of printing with the speed of the web.

All flexographic printers consist of a print cylinder, printing plate, anilox roll, fountain roll, ink fountain, ink and impression roll, and operate in the following manner: The ink fountain is filled with enough ink to wet the bottom half of the fountain roll which is positioned in the fountain. As it rotates, ink is picked up on the fountain roll and transferred to the anilox roll which is positioned parallel to it. The combination of the type of engraving on the anilox roll and the amount of squeeze between the anilox roll and the fountain roll determines the volume of ink transferred. As the anilox roll and print cylinder rotate, the ink is transferred to the printing plate which is mounted to the surface of the print cylinder. The web, which is positioned between the print cylinder and the impression roll, is printed when the print cylinder and inked printing plate roll over the web and transfer the message on to the web.

SUMMARY OF THE INVENTION

One of the differences between the present invention and all other flexographic printers is the manner in which printing occurs. All other printers are powered by either a motor (mechanical drive) or by the web itself (friction drive). The present invention uses both methods (mechanical drive and friction drive) at the same time so that the benefits of both mechanical and friction drive are realized without experiencing any of the problems. This feature is important because the key to maintaining print quality is that the surface speed of the print cylinder (actually the surface speed of the printing plate on the cylinder) remains exactly the same as the speed of the web while the printing plate is in contact with the web. Since the speed of most packaging machines continuously ramps up and down during one packaging cycle, matching the cylinder and web speeds is difficult to maintain.

When using only a mechanical drive, a sophisticated encoder and PLC is required to monitor the web speed and send instructions to the motor to constantly increase or decrease speed. This method is not only expensive, it requires an experienced operator to set it up and keep it adjusted. When using friction drive, the web must power not just the print cylinder, but all of the components that make up the flexographic printer including the gear train, the anilox roll, the fountain roll, the impression roll, idler roll and anything else that is connected. This puts a tremendous strain on the web causing it to stretch or tear or lose registration. When this happens, the entire packaging machine must be shut down and reset.

The solution to these problems included in the present invention is to split the power requirement into two separate parts. First, the print cylinder is rotated by one drive while printing (during the print cycle). Second, the print cylinder is rotated past the anilox roll (during the inking cycle) by another drive, and the print cylinder is reset to the start position ready for the next printing cycle.

The first power requirement is met through a unique friction drive mechanism in which the web is "trapped" between a nip roll and pinch roll during the printing cycle, to thus drive the print cylinder and virtually nothing else, along with two drive bearers which are part of the printing plate and are in contact with the impression roll, not the web, only during the print cycle. Since the weight of the print cylinder alone is a fraction of that of the entire printing system, no strain is put on either the web or the packaging machine.

The printing cylinder, during printing, is friction powered by a geared S WRAP drive system which allows for registration between imprints of +/−0.060". This is accomplished by trapping the web during the printing cycle so that as the web speed increases or decreases so does the speed of the print cylinder. By staying in constant contact with the web the printer will operate up to 30 cycles per minute, which is greater than the speed of most packaging machines available today.

The second power requirement is met through a simple fixed speed motor which is powerful enough to drive and reset the entire system before the next print cycle begins so that the next print cycle can be powered by the friction drive mechanism. Since the speed of the fixed speed motor has no relationship with the speed of the web, no special controls are needed. During the friction powered drive of the printing cycle, the direct drive motor is disengaged.

The print cylinder (sometimes called a plate cylinder) is what the printing plate is attached to in order to rotate the printing plate past the anilox roll (inking) and over the web (printing). While all other print cylinders are a full 360 degrees around, the print cylinder of the invention is preferably less than 360 degrees around, and most preferably includes a curved face measuring only 170 degrees around. In addition, the print cylinder is not made out of the traditional materials of aluminum or steel, but rather the print cylinder is made from plastic.

This plastic print cylinder design minimizes the power required to rotate the cylinder in several ways. First, the cylinder is very light, about one-third the weight of a traditional cylinder. Second, the positioning of the inking (anilox roll) and printing (impression roll) components are 180 degrees apart as the cylinder rotates. This means that the cylinder is never in contact with more than one roll, keeping drag to a minimum. It is not unusual to find in other printers that the printing plate is in contact with the anilox roll and the web simultaneously, causing more drag to be overcome by the power source.

Traditionally, the printing plate is attached directly to the print cylinder by means of double-sided adhesive tape or a flexible magnetic strip. Both methods require the operator to correctly position the plate on the cylinder, and even scribe lines on the cylinder cannot ensure correct positioning of the plate. In addition, constant removal of adhesive backed plates results in the build-up of glue on the cylinder, which must be kept clean. While magnetic plates do not have this problem, they can only work with steel surfaces which are very heavy and very expensive.

The present printing plate system of the invention eliminates all of these problems. All printing plates are pre-mounted permanently to a mylar carrier sheet that is designed with pin and hook holes that line up with pins and hooks that are part of the print cylinder. This means that the operator will always mount the plate in the exact location on the cylinder the first time. The setting of the printing plate on the carrier sheet has been arranged previously.

In addition, these plates have drive bearers as part of the mylar carrier sheet, as opposed to drive bearers that are part of the print cylinder. This means that the bearers and the printing plate wear down together at the same rate to maintain print quality.

In all other systems that utilize drive bearers, the bearer is a part of the print cylinder and must be replaced when the operator realizes that the drive bearers have been worn down or if the printing plate has worn down more than the drive bearers. The present invention allows for quick and easy plate changes, automatic plate location on the print cylinder in the proper position, and easy storage of plates when not in use; since the adhesive backing found on other plates is not part of this system, special protection is not necessary or needed for the print cylinder.

Traditionally, in an ink pumping system, ink is continuously circulated from a gallon pail of ink to the ink fountain, and back to the pail. This reduces the need to refill the ink fountain, as well as keeping the ink mixed, if necessary.

The ink management system used for the invention recirculates ink and much more The ink management system of the invention not only circulates the ink, it also cleans the entire ink system, separates the ink from the waste and the cleaner (solvent). It also measures the pH of the ink or the viscosity level of the ink and automatically adds pH adjuster or thinner. In addition, the ink is supplied in sealed ink cartridges, which are not poured into an ink pail. A cap is designed especially for the cartridge and snaps into place eliminating evaporation and spills and provides ports for control of ink flow.

The ink management system maintains the correct amount and flow of ink, provides a "hands off" cleaning cycle, and automatically adjusts and maintains the ink's pH and/or viscosity. As a result, the printer has the ability to utilize both water base and alcohol base inks, print on all types of substrates, and operate continuously and trouble free in all environments.

The installation of the printing system of the invention is quite simple as it is designed to sit on the bed of a packaging machine. When properly situated, the side of the printer with the motor, the pulleys, and the control box hangs over the back of the packaging machine with the entire unit, as close as possible, to the sealing die. Once located on the bed, the printer is accurately aligned. The correct alignment is made when the center lines of the print cylinder, the web and the packaging machine all coincide and all the rollers of the printer are parallel with the rollers on the packaging machine.

After the positioning of the printing system it is bolted to the packaging machine's frame for permanent mounting. This is done by marking the bolt hole locations on the machine bed through 3" slots located in two mounting feet plates, sliding the printer out of the way, drilling and then tapping $\frac{3}{8}$" - 16 holes in those locations, repositioning the printer over the holes, and finally bolting the machine in place.

In those instances where the packaging machine loading area is insufficient for standard installation, the printing system may be installed on top of the hood of the packaging machine. In this case a bracket is provided that is designed for a specific model form, fill and seal machine that will operate the printing system in that position.

The printing system control box requires standard 115 VAC, 20 AMP service. In addition, the system requires a trigger signal from the packaging machine to begin the printing cycle that is at least 50 milliseconds long, this signal can be either 24 VDC, 115 VAC, 230 VAC or dry contact, whichever is provided by a particular packaging machine. An appropriate relay of the printing system will interface between the trigger signal and the control box. The signal itself must be an "index" signal since the printer must begin printing as soon as the web begins moving. A typical signal is available from the "tools down" location.

The printing system requires about 50 PSI to operate. Clean, dry lubricated air should be provided in a $\frac{1}{2}$" line to the air regulator, which is mounted near the control box on the back of the printer.

The ink management system is equipped with a pump and valve system that is packaged in a stainless steel control box. The ink management system is mounted on the back of the packaging machine under the overhanging portion of the printing system, or on a movable cart. There are a series of hoses that connect the ink cartridge, solvent and waste container to the pump and another series of hoses that connect the pump to the ink fountain. Each hose is clearly marked with a label indicating the correct hose fitting. The ink management system requires standard 115 VAC power; on some systems the pump is wired directly into the printing system control box while on other systems, power is separate.

A peristaltic pump transfers fluids by sequentially "squeezing" a flexible tube through which the fluid is flowing. This tube is replaced on a regular basis, every 4 to 6 weeks.

Water based pigment inks are designed for good adhesion to paper and TYVEK and are not suited to non-porous surfaces. This ink is supplied in disposable ink cartridges, press ready at a viscosity between 18 and 22 seconds, Zahn #2 cup, at 25 degrees centigrade. These water base inks should be maintained at a pH level between 8.9 and 9.2. In water base inks it is solid pigments that give the ink color, density, and body and which are much more soluble when the pH is at an acceptable level. Evaporation, due to exposure to air or excessive heat, will lower the pH and if it reaches the 8.5 level, the viscosity will change and the print quality will suffer.

The ink cartridge and the volume of ink in the cartridge are designed specifically to keep evaporation to a minimum, whereas the only way to maintain the pH level is to replace the evaporated material. This is accomplished by using the ink management system drip feeder. The pH additive maintains the pH and viscosity at the same time by the addition of ink base without pigment.

Alcohol base inks are designed to be used only when printing on non-porous surfaces, since they dry as the alcohol present evaporates. Like water base inks, alcohol base inks will change if exposed to heat and evaporation, however, they are not nearly as volatile as water base inks and changes occur much slower. pH is not a factor. Generally, a cartridge should be used up before the viscosity changes significantly enough to alter the print quality. If, however, the ink does need solvents added, the drip feeder can be utilized.

It is an object of the present invention to provide a flexographic printing system used in conjunction with an intermittent motion form, fill, and seal packaging machine.

It is another object of the present invention to provide a flexographic printing system used in conjunction with an intermittent motion form, fill, and seal packaging machine with a dual drive system, a plastic print cylinder having a mylar carrier sheet including a printing plate and an ink management system for circulating ink, and for cleaning the entire inking system while separating ink from waste and cleaner.

It is yet another object of the present invention to provide a flexographic printing system used in conjunction with an intermittent motion form, fill, and seal packaging machine, having a dual drive system including a friction drive and a mechanical drive.

It is still yet another object of the present invention to provide a flexographic printing system used in conjunction with an intermittent motion form, fill, and seal packaging machine, with a plastic print cylinder having a printing plate attached to a removably mounted mylar carrier sheet having drive bearers on the carrier sheet.

It is still yet another object of the present invention to provide a flexographic printing system used in conjunction with an intermittent motion form, fill, and seal packaging machine, having an ink management system for controlled recirculation of ink to a fountain, and for cleaning of the entire inking system while separating ink from waste and from cleaner.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
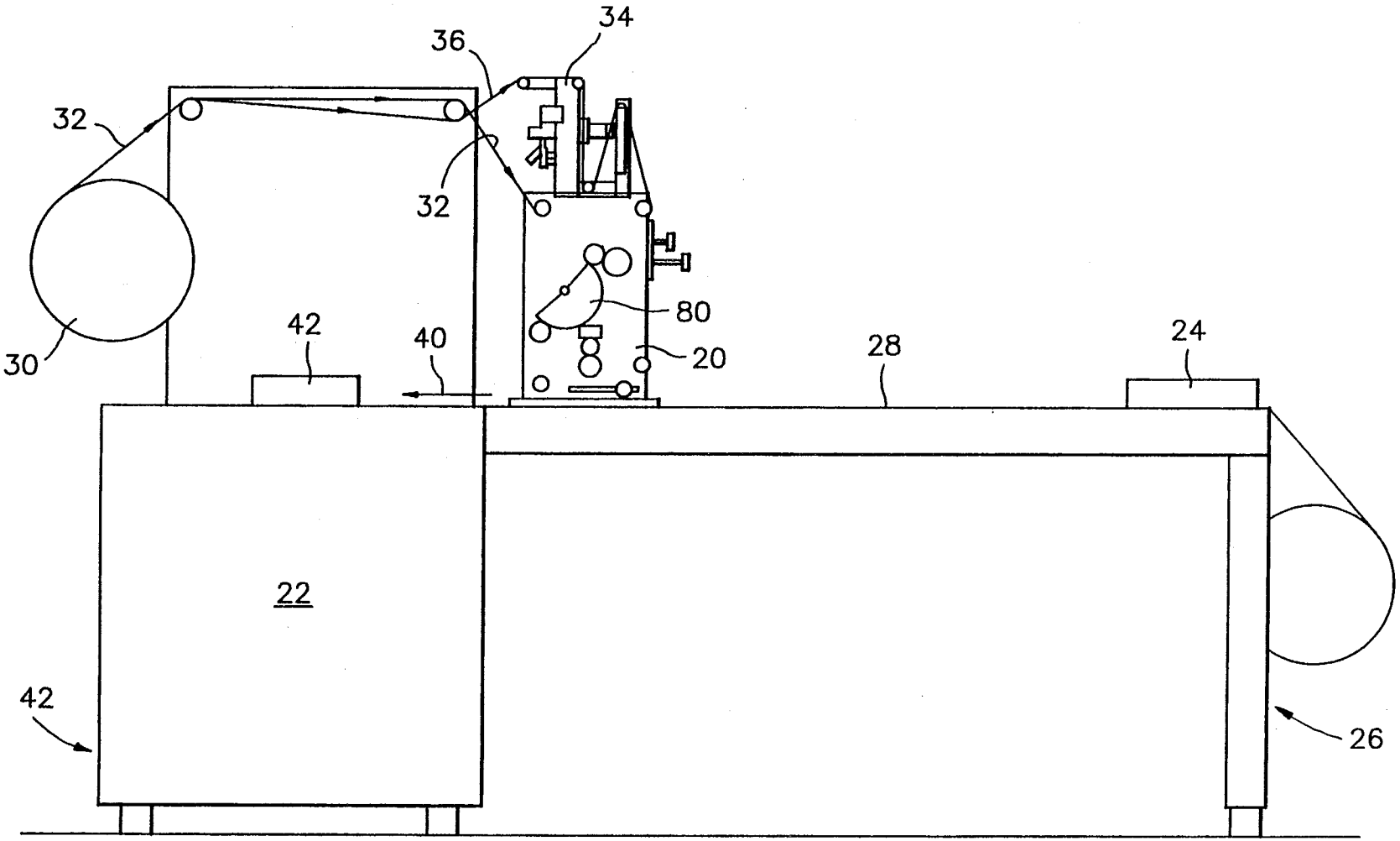
FIG. 1 is a schematic view of a flexographic printing system of the present invention located on top of a packaging machine.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1–4, in particular, a flexographic printer embodying the teachings of the subject invention is generally designated as 20. With reference to its orientation in FIG. 1, the flexographic printer is mounted on top of a form, fill and sealing packaging machine 22. Packages are lined up in forming area 24 located at the rear 26 of the packaging machine 22. The packaging is filled in a loading area 28 and advanced towards the flexographic printer 20. A supply roll 30 of web 32 to be printed, advances towards the flexographic printer 20. An optional multiple column coder (mcc) 34 is mounted on top of the flexographic printer for printing of a web 36, slit from web 32, to include such information as expiration dates.

As web 32 advances into the flexographic printer 20, it is aligned with a printing plate on a printing cylinder 80 in registration with the forms from the packaging machine advancing underneath the flexographic printer. Printing cylinder 80 is not actually a "cylinder" as will be explained in greater detail later.

Web exiting from the flexographic printer as indicated by arrow 40 is aligned with a filled form which is sealed to the form at sealing area 42. The web 32 is sealed to a filled form to make a completed package which advances towards the front 42 of the packaging machine.

Figure 2:
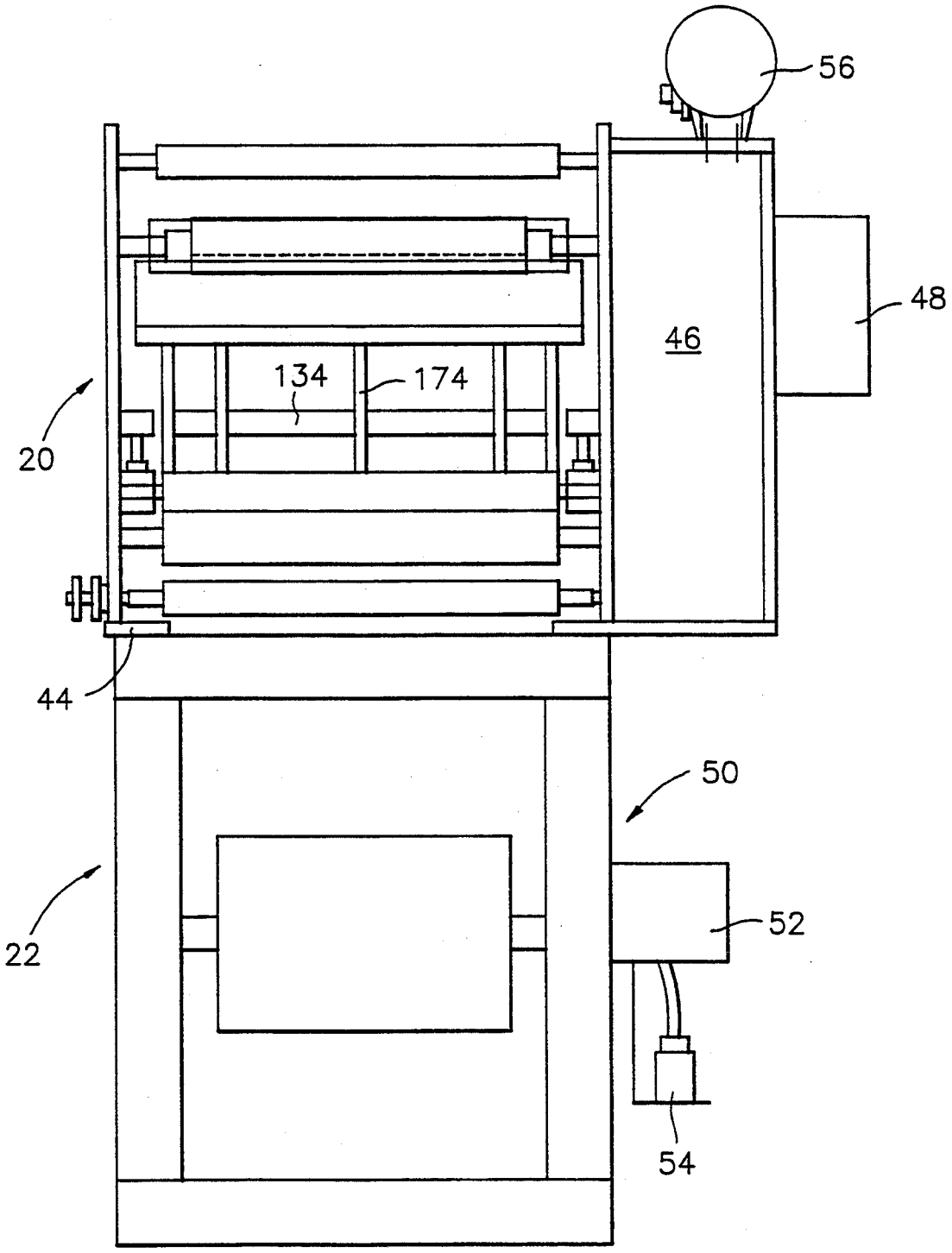
FIG. 2 is a rear view of a flexographic printing system located on top of a packaging machine.

In FIG. 2, a flexographic printer 20 is shown mounted onto packaging machine 22 by alignment feet 44. A gear box 46 controls the interaction of the various rolls of the flexographic printer to provide aligned, registered printing of the web. An operator control box 48 is accessible from the back side 50 of the packaging machine and the flexographic printer. Shown mounted below the flexographic printer on the backside 50 of the packaging machine is an ink management system (IMS) pump 52 for regulating flow of ink, solvent and waste to or from one canister 54 of three canisters used for the ink management system of the present invention.

Figure 3:
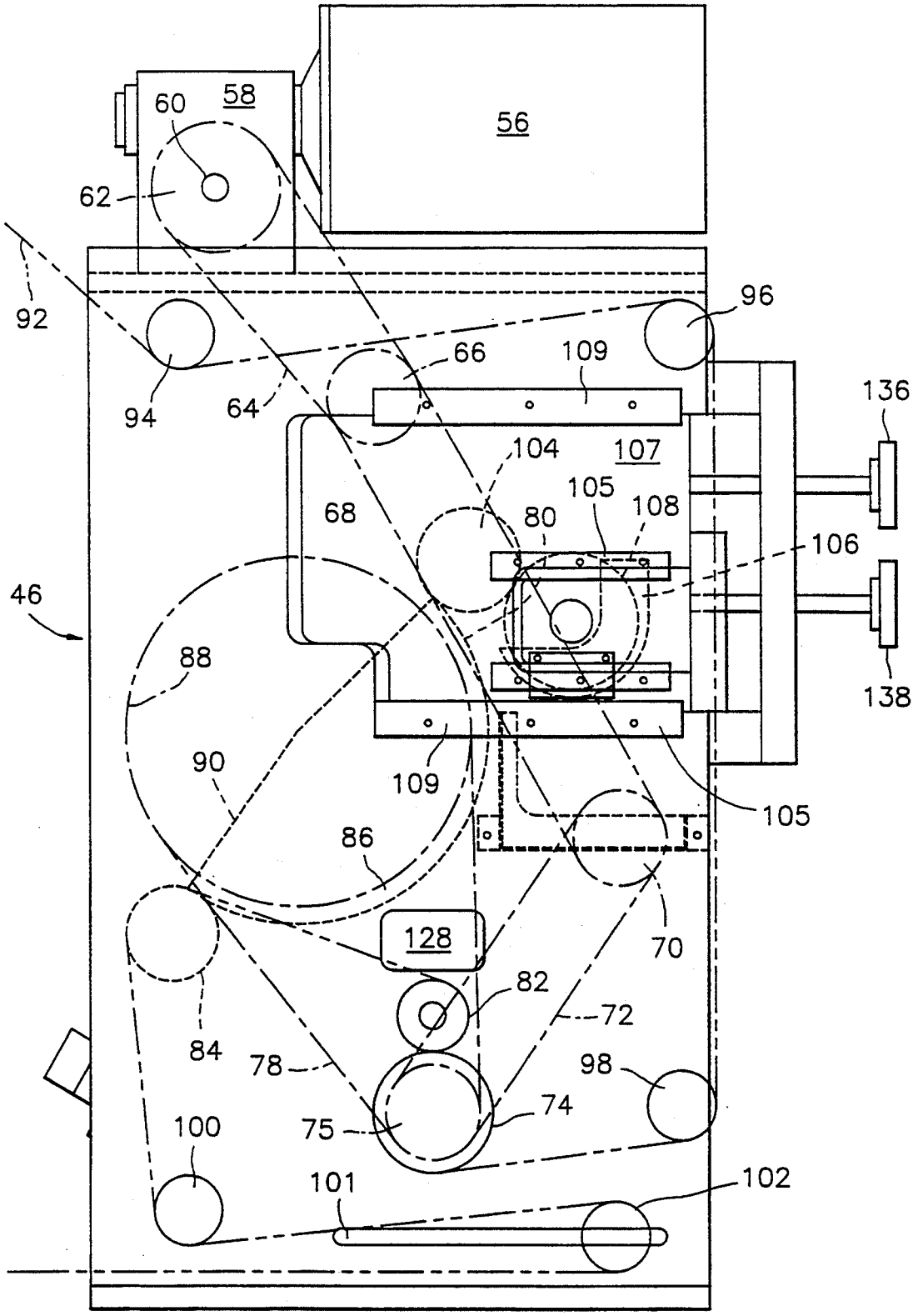
FIG. 3 is an assembly drawing of a flexographic printer.
Figure 4:
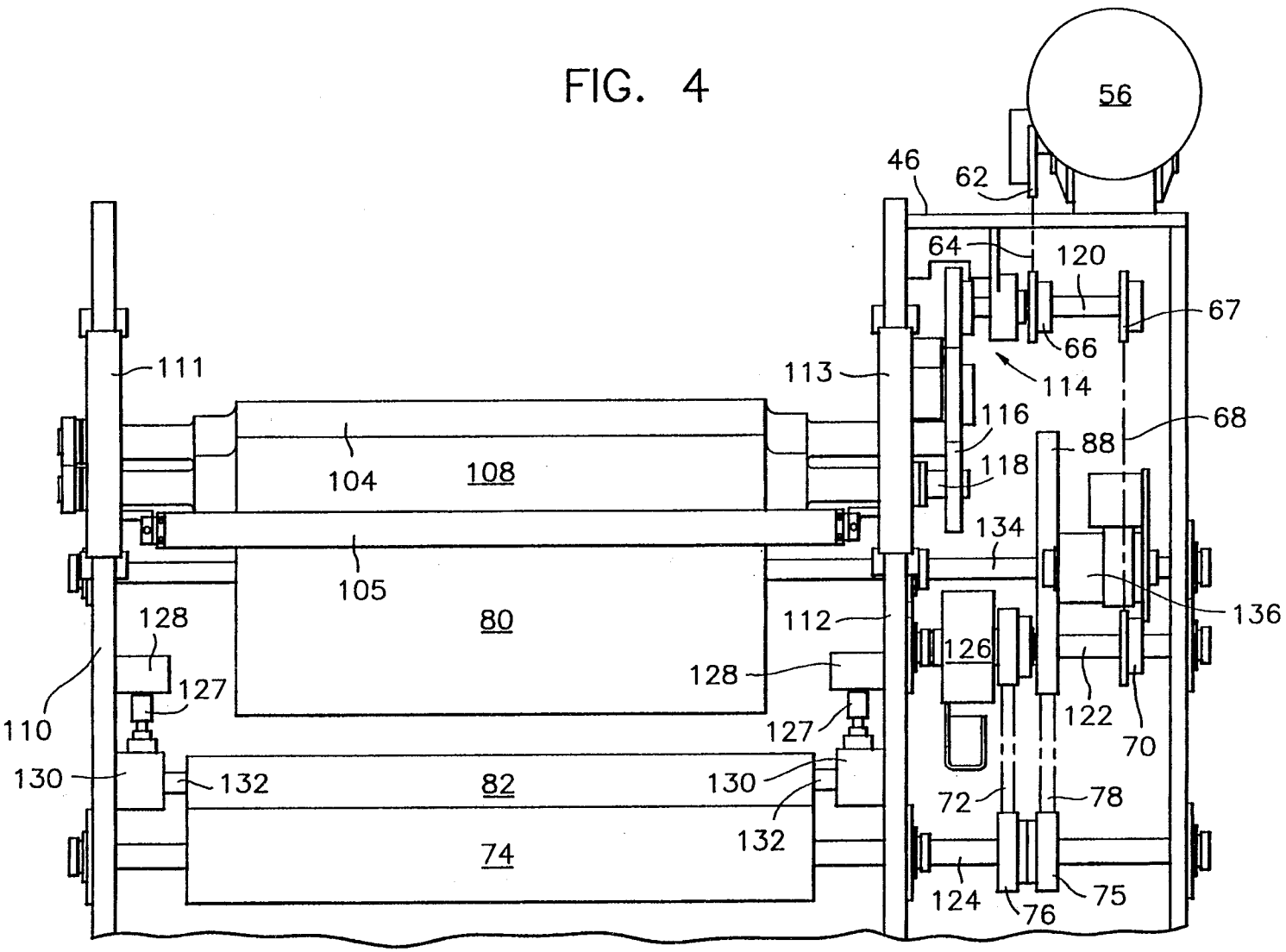
FIG. 4 is an assembly drawing of a mechanical drive system for a flexographic printer.

In FIGS. 3 and 4, a detailed view of the dual drive system included in gear box 46 in FIG. 2 of the flexographic printer is shown. An a.c. motor 56 mounted on top of gear box 46 is connected to a speed reducer 58 having a drive shaft 60 for driving a drive sprocket 62. The drive sprocket 62 is connected by a chain 64 for rotation of sprocket 66. Sprocket 66 is connected by chain 68 to sprocket 70. Sprocket 70 is connected by belt 72 to nip roll 74. Nip roll 74 includes a nip roll shaft 124 with a drive pulley 76 about which belt 72 is run. A second drive pulley 75 located on nip roll shaft 124 has a belt 78 run about it for engagement with pulley 88 for driving print cylinder 80.

For the mechanical driving of the print cylinder 80 during an inking cycle (between printing cycles), a.c. motor 56 is energized and clutch 126 engaged to rotate print cylinder 80 to a position located at the beginning of a print cycle. During this mechanical driving of the print cylinder by a.c. motor 56, pinch roll 82 is moved by pneumatic piston cylinders 127 away from nip roll 74. Also, impression cylinder 84 is moved by pneumatic piston cylinders ( not shown) away from contact with printing plate 86 which is located on a periphery of a portion of print cylinder 80. Print cylinder 80 includes a pulley 88 mounted on clutch 136, which is mounted on print cylinder shaft 134 about which belt 78 is run. It is understood that the majority of the print cylinder occupies only a portion of a cylinder as represented by dashed line 90.

During the printing cycle with the pinch roll 82 engaging nip roll 74 and impression cylinder 84 engaging printing plate 86 as shown in FIG. 3, web 92 passes around idler rolls 94, 96 and 98 until engaging with nip roll 74. The web then passes between the pinch roll and nip roll and between the impression cylinder and the printing plate 86. The belt 78 connecting the drive pulley 75 and drive pulley 88, drives the print cylinder at the exact same speed as the web passing around the nip roll 74 during the printing cycle to ensure the same speed between the web and the plate cylinder. The print cylinder is rotated through a single printing of the web by the frictional drive of the nip roll by the web. This assures a perfect printing of the web since the web is used to frictionally drive only the print cylinder of the flexographic printer. Upon termination of the printing cycle, the a.c. motor 56 is engaged for a mechanical driving of the printing cylinder during movement of the pinch roll 82 away from the nip roll 74.

After the frictional driving of the print cylinder, the printing plate 86 will have passed by impression cylinder 84. The pneumatic piston cylinder controlling the pinch roll will move the pinch roll slightly away from the nip roll 74 and the motor 56 engaged by a clutch to index the print cylinder by mechanical drive through an inking cycle to a position located at the beginning of the next print of the printing plate on the web.

The speed at which the print cylinder is indexed through the inking cycle is done regardless of the speed of the web, and therefore may be as fast as possible to prepare for the next printing at a very short time interval. After indexing of the print cylinder through the inking cycle, the pinch roll 82 is then moved back into contact with the nip roll 74 for frictional drive of the print cylinder by the web while at the same time, the motor 56 is disengaged from mechanically driving the printing cylinder. The motor 56 continuously drives the inking rolls.

Upon printing of the web, the web proceeds around idler roll 100 to registration roll 102 for subsequent processing with a filled form package.

Figure 9:
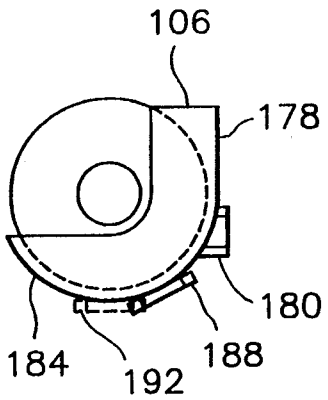
FIG. 9 is a side view of the inking fountain shown in FIG. 8 with hose connections.

Inking of the printing plate 86 is accomplished by anilox roll 104 as inked from fountain 106 by contact with fountain roll 108. The fountain roll 108 and the anilox roll 104 are continuously driven by motor 56. The details of the ink management system will be explained in greater detail with reference to FIGS. 9–11.

In FIG. 4, the nip roll 74, pinch roll 82, and print cylinder 80 are shown mounted between two side walls 110 and 112 of the flexographic printer 20. The fountain roll 108 and anilox roll 104 are mounted in bearing plates 111, 113 located in the side walls 110, 112 of the flexographic printer 20.

Gear box 46 illustrates how the shafts of the various rolls are driven through the side wall 112 of the flexographic printer. As also shown in FIG. 3, a.c. motor driving sprocket 62 transmits rotary motion through chain 64 to a series of interengaged gears 114 to gear 116 located at the end of fountain roll shaft 118. The anilox roll 104 is thereby continuously driven in contact with the fountain roll for inking of the printing plate 86. The fountain roll and anilox roll are shown as being continuously rotated by the a.c. motor 56.

Chain 64 drives sprocket 66 mounted on shaft 120 which, in turn, drives sprocket 67. Chain 68 mounted on sprocket 67 rotates sprocket 70 which, in turn, drives shaft 122 to which the nip roll shaft 124 is connected by belt 72. To drive nip roll shaft 124 by belt 72, clutch 126 is engaged. During the engagement of clutch 126 for mechanically driving of the nip roll by a.c. motor 56, pinch roll 82 is moved away from the nip roll 74 by activation of pneumatic piston cylinders 127 mounted on blocks 128 for movement of the blocks 130 of the pinch roll shaft 132.

During engagement of clutch 126, belt 78 rotated by rotation of nip roll shaft 124 causes rotation of print cylinder shaft 134 to drive print cylinder 80 by the engagement of clutch 136. When clutch 136 is disengaged as is clutch 126 disengaged, nip roll 82 is moved by piston cylinders 127 into engagement with nip roll 74 for frictional drive of the print cylinder 80 by engagement of the web between nip roll 74 and pinch roll 82.

Clutches 126 and 136 are both engaged during the nonprinting or index inking for movement of the print cylinder through a predetermined amount of rotation as mechanically driven by motor 56 to index the printing cylinder for set up of the next printing cycle. Conversely, during the frictional drive by the web of the printing plate through the printing cycle, clutches 126 and 136 are both disengaged. Clutches 126 and 136 are available from Warner Electric of South Beloit, Ill., as part numbers CB-6 and SF-400, respectively.

The operation of the flexographic printer is as follows:

1. The power on switch starts the fixed speed motor 56 which continuously drives the inking system and the input shaft 122 of the clutch 126.
2. The web of the packaging machine is not moving at this time.

3. The packaging machine sends "start the cycle" signal to the flexographic printer of the invention.
4. Timer-1 receives the signal and disengages the clutch 136 and the clutch 126 which releases the shaft 134 of the print cylinder 80 to allow the possibility of the print cylinder 80 to rotate with the web 92 when the web 92 begins to move by the frictional drive of the web on the nip roll 74, transferred to the print cylinder by a belt 78 driven by nip roll 74.
5. Timer-1 also sends a signal to Timer-3 (in some packaging machines, a separate signal is sent directly by the packaging machine to Timer-3) which closes the pinch and nip rolls together by piston cylinders 127, trapping the web between them and moves the impression roll 84 into position by piston cylinders to back-up the printing plate 86 when the print cylinder 80 rotates past it, printing the web 92. The printing plate 86 includes drive bearers on either side of it, which are in contact with the impression roll 84, but not the web 92, while printing is taking place. Also, when the pinch 82 and nip rolls 74 are closed together around the web 92, the combination of friction drive from contact with the web and mechanical drive by belt 78 rotating drive wheel 88, are working together during the printing cycle.
6. Timer-1 sends the signal to Timer-2 which holds the signal until it is time to ink.
7. The packaging machine now indexes, moving the web one package length. The web will now friction drive nip roll 74 and thereby belt 78 to drive the print cylinder, which prints the web at the same speed as the web as the inked printing plate makes contact with the web. During printing the web is supported by the impression roll, which is positioned parallel to the print cylinder 80 on the other side of the web 92.
8. Timer-2 is an adjustable on delay/off delay timer which has been set to hold the signal received from Timer-1 until the printing is complete, (when the printing plate is no longer making contact with the web,) and then send the signal to Timer-3.
9. Timer-3 backs the impression roll away from the web by piston cylinders (in a manner similar to pinch roll 82 backing away nip roll 74 by piston cylinders 127) and separates the pinch and nip rolls from each other.
10. Timer-2 also engages clutch 126 so that it is possible for the print cylinder 80 to be mechanically driven by motor 56 the remainder of its approximately 180 degree cycle.
11. The packaging machine completes one cycle and the web stops moving.
12. Timer-2 now sends the signal back to Timer-1 to engage clutch 136 which transfers the power from the motor 56 through the engaged clutch 126 to rotate the print cylinder the remaining approximately 180 degrees to ink the plate 86 by the anilox roll 104 and reset the print cylinder 80, waiting for the next "start the cycle" signal.

Figure 5:
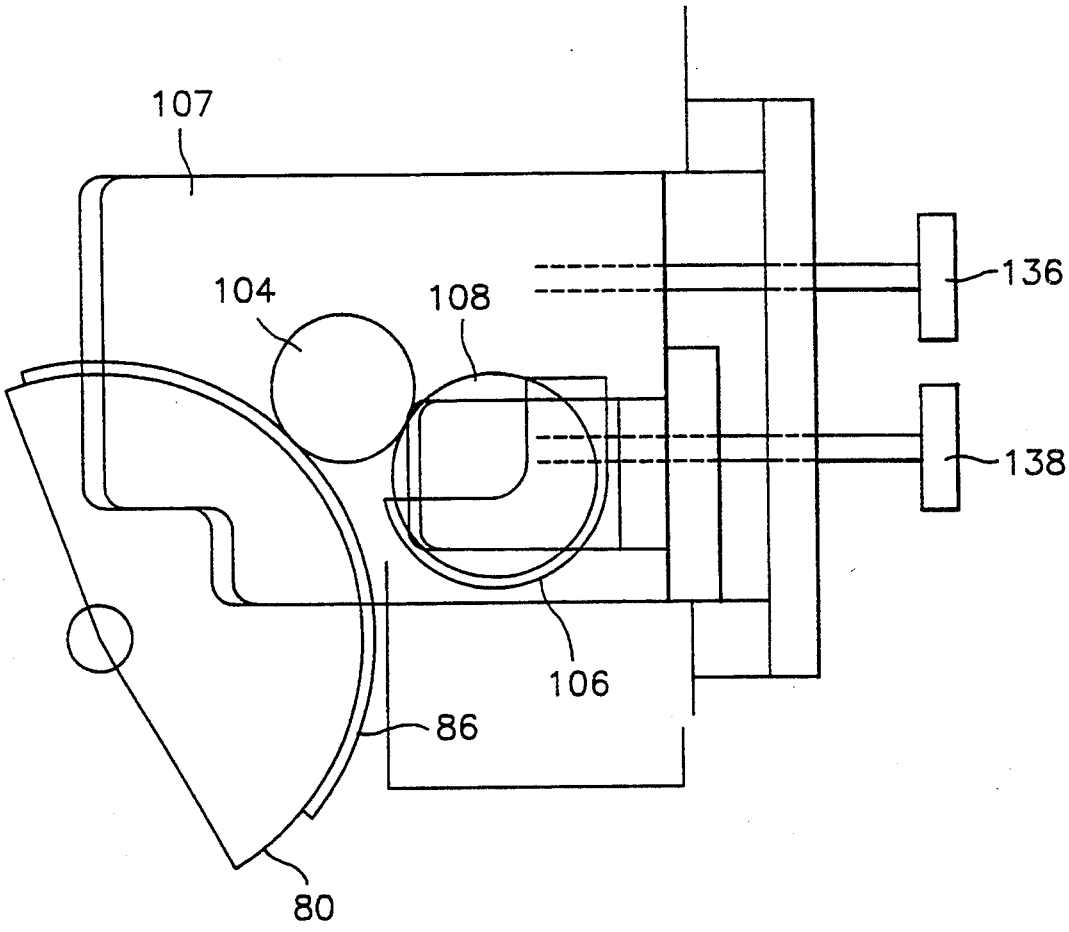
FIG. 5 is a side sectional view of an adjustment arrangement for an inking system.

In FIG. 5, adjustment of the anilox roll 104 and the fountain roll 108 are shown by the adjustment of control hobs 136 and 138, respectively. By the adjustment of control knobs 136 and 138, the amount of ink transferred from fountain 106 to the anilox roll 104 by the fountain roll 108 is varied. Control knob 136 varies the position of the anilox roll 104 with respect to the printing plate 86 by sliding of plate 107 along strips 109 (see FIG. 3). Control knob 138 varies the position of the fountain 106 and thereby the fountain roll 108 with respect to anilox roll 104 by movement of the fountain 106 along slide bar 105.

Figure 6:
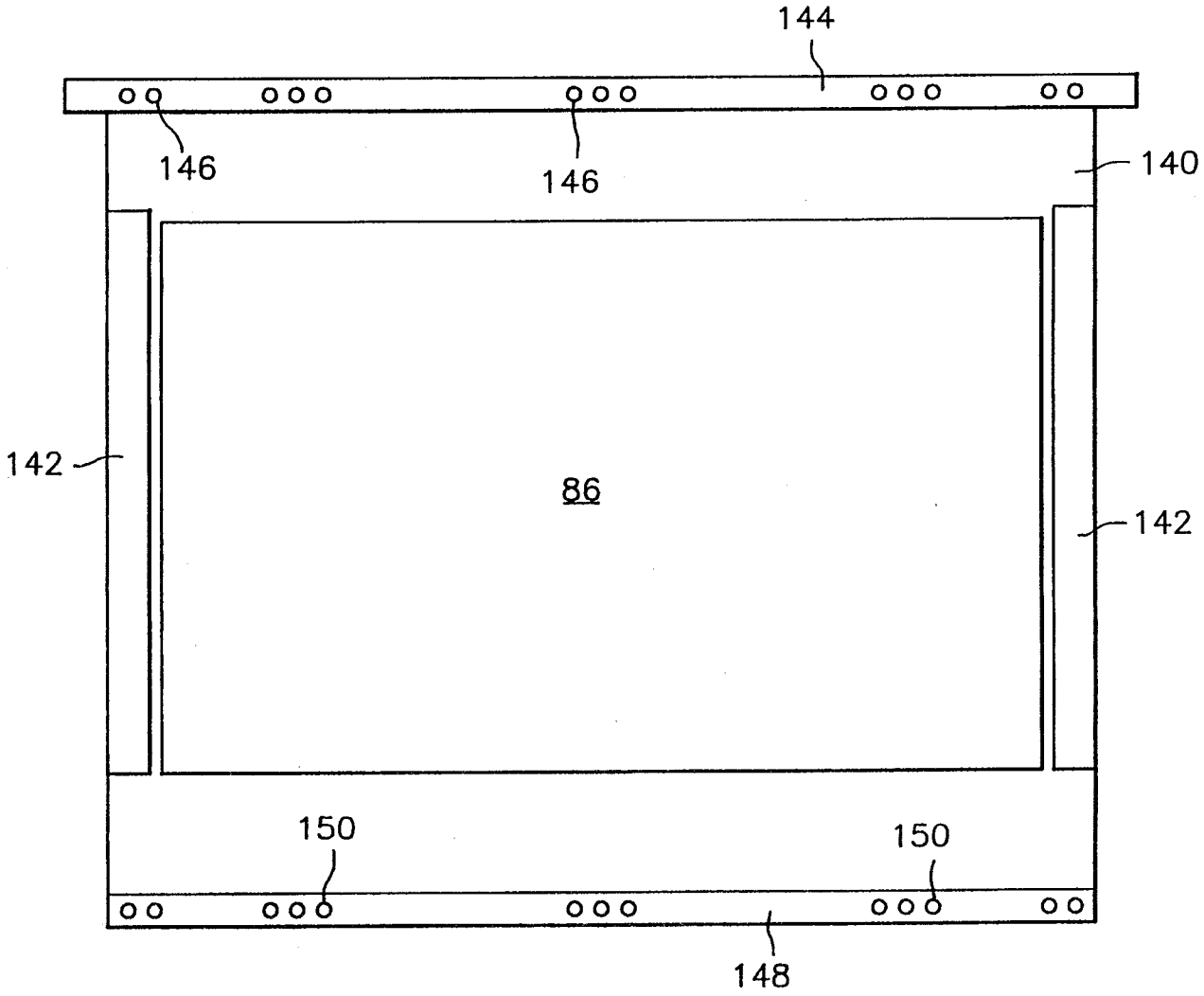
FIG. 6 is a plan view of a mylar carrier sheet with photopolymer printing plate.
Figure 7:
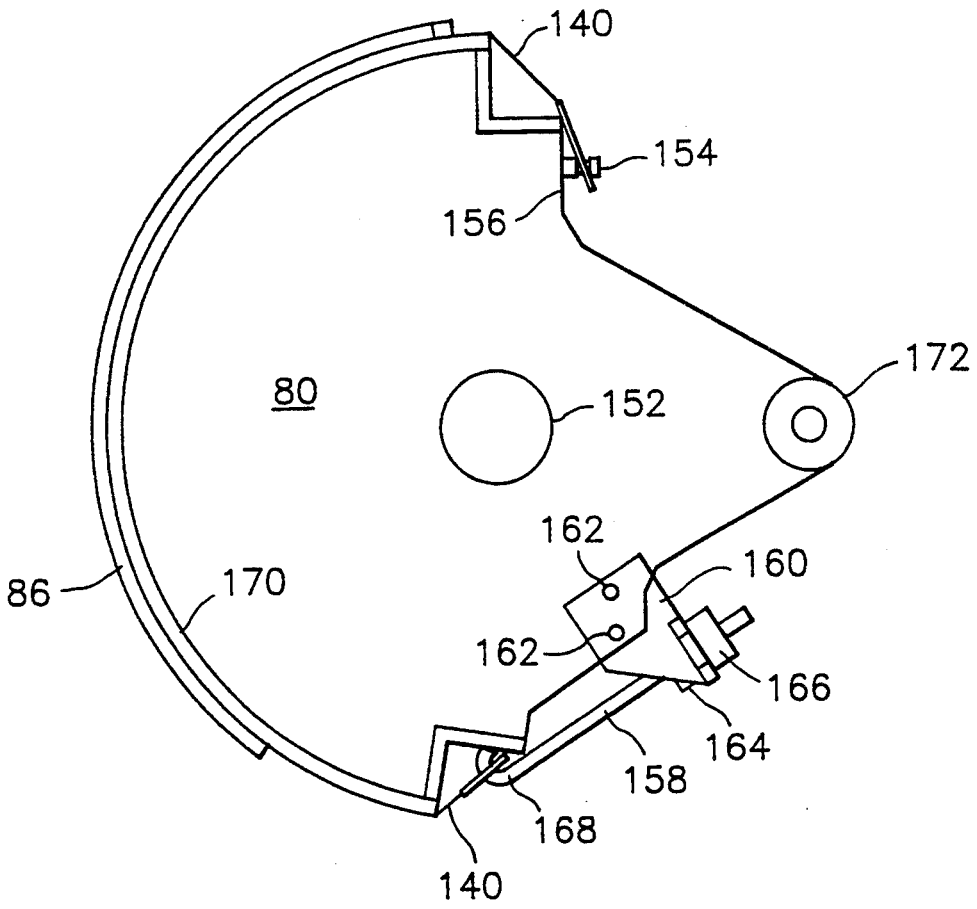
FIG. 7 is a side sectional view of a mylar carrier sheet mounted on a plastic print cylinder.

In FIG. 6 and 7, a flex print carrier sheet 140 is shown as including a photopolymer printing plate 86 having drive bearers 142 located on opposite sides of the printing plate 86. The drive bearers are separate from and longer than the printing plate towards a leading edge for buffered initial engagement with the impression cylinder 84. The carrier sheet is made of a mylar material and includes a steel leading edge strap 144 with a series of pin holes 146 and a steel trailing edge strap 148 having a plurality of spaced hook holes 150.

For mounting the carrier sheet on a print cylinder having central opening 152 for receipt of a print cylinder shaft 134, the leading edge 144 of the carrier sheet is inserted on pins 154 spaced across an edge 156 of the print cylinder 80 in a row extending parallel to the longitudinal axis of the print cylinder passing through the center of opening 152. The opposite end of the carrier sheet 140 is secured to the print cylinder 80 by hooks 158 which engage in hook holes 150. The hooks 158 are located in a mounting block 160 secured by rivets 162 to the print cylinder. A lock knob 164 aligns the hooks so that upon turning of tightening knob 166, the curved portion 168 of hooks 158 engage the hook holes 150 of the trailing edge 148 of the carrier sheet 140. The hooks 158 are moved to tension the carrier sheet and secure it to the curved face plate 170 of the print cylinder 80.

The print "cylinder" is made of a plurality of plastic plates 174 connected to a face plate 170 which is curved and forms only a portion of a circular surface. A central print cylinder shaft 134 passes through holes 152 of the spaced plates 174. A second shaft 172 extends parallel to shaft 134 through a plurality of plates 174 spaced along the shaft. These plates are of a profile configuration shown in FIG. 7 and each may include a pin 154 and hook assembly as shown to retain a carrier sheet in position on face plate 170 interconnecting all of the plates 174.

Therefore, the print cylinder is not a "cylinder" but is formed of a series of plates having partially circular peripheries as shown schematically in FIG. 2 as a series of five spaced apart plates 174 having a central shaft 134 and also including a shaft 172 as shown in FIG. 7.

The print cylinder 80 is of considerable less weight than a traditional print cylinder since it forms only part of a cylinder and is hollow in many areas. Further, the eccentric mounting of shaft 172 adds momentum in the turning of the print cylinder when driven by motor 56 to index the print cylinder to the next print cycle positioning.

Figure 8:
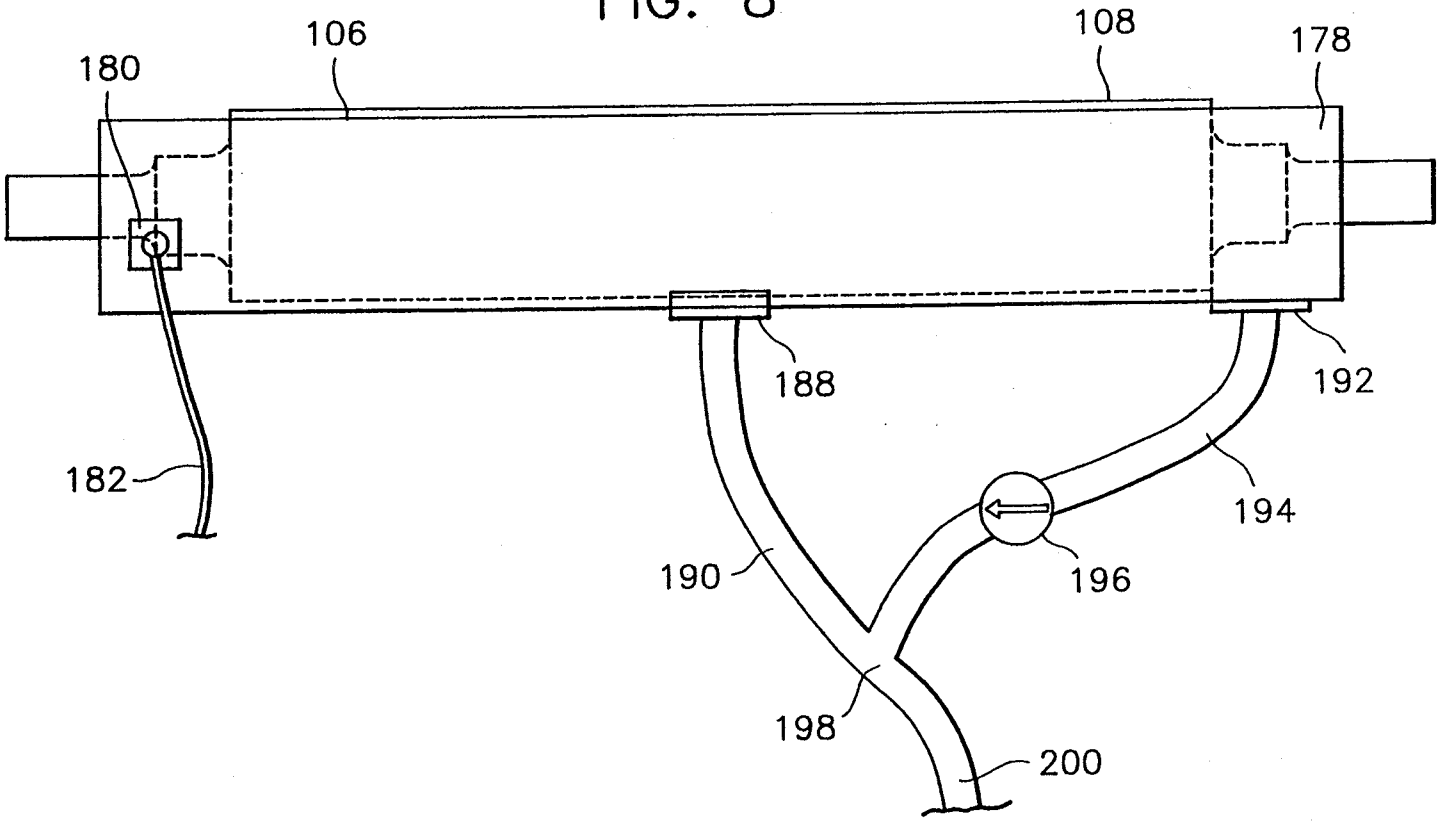
FIG. 8 is a rear view of an inking fountain with hose connections.

FIG. 8 is a rear side view of fountain 106 with fountain roll 108 protruding slightly above the top of the fountain. On the side wall 178 of the fountain is an inlet connection 180 with an infeed hose 182 connected thereto. The infeed connection 180 is located at a point approximately half-way up the side wall 178. Along the curved bottom wall 184 of the fountain 106 is located a drain connection 188 having drain hose 190 connected thereto. Also, at the bottom of the curved bottom wall 184 is a total drain connection 192 with a total drain hose 194 connected thereto with a valve 196 located in the hose 194 upstream from a Y-connection point 198, where the hose 190 and hose 194 merge and form drain line 200.

To initiate operation of the printing system the following steps are taken:

a. Using the upper set of adjusting knobs 136, the anilox roll is backed away from the plate cylinder 80 by turning clockwise.

b. The system is powered up by turning a control box knob to the "HAND" position. This disengages the clutch 136 allowing the print cylinder to turn freely.

c. The print cylinder 80 is rotated so that the carrier sheet locking pins are accessible. The leading edge 144 of the sheet is mounted over the pins 154. The cylinder is rotated until the locking hooks 158 can be placed into the carrier sheet and tightened down by hand. The steel strip on the leading edge 144 of the carrier sheet is always wider than the strip on the trailing edge of the sheet to distinguish between the leading and trailing edges.

d. The lower set of adjusting knobs 138 are turned clockwise to back the rubber fountain roll away from the metal anilox roll.

e. The print cylinder is rotated so that the plate 86 is in front of the anilox roll 104.

f. The upper set of adjusting knobs 136 are turned counterclockwise to move the anilox roll forward into the printing plate 86 until kiss contact is made. One method used to determine the ideal kiss contact setting is to position a piece of web between the anilox roll and the face of the printing plate and move the anilox roll forward until it is "nipped" between the roll and plate. Both sides of the anilox roll are adjusted simultaneously to prevent cocking.

g. The web is threaded through the printing system as shown on the threading diagram of FIG. 3.

h. Printing now may be initiated.

The pumping feature of the ink management system is designed to either pump ink from the ink cartridge through the fountain and back into the cartridge, or pump solvent into the fountain to thoroughly clean the system and back into either the solvent container or total waste container. In addition, a drip feed mechanism designed for replenishing pH adjuster in water based inks, or solvents in alcohol base inks, is part of the system.

Figure 10:
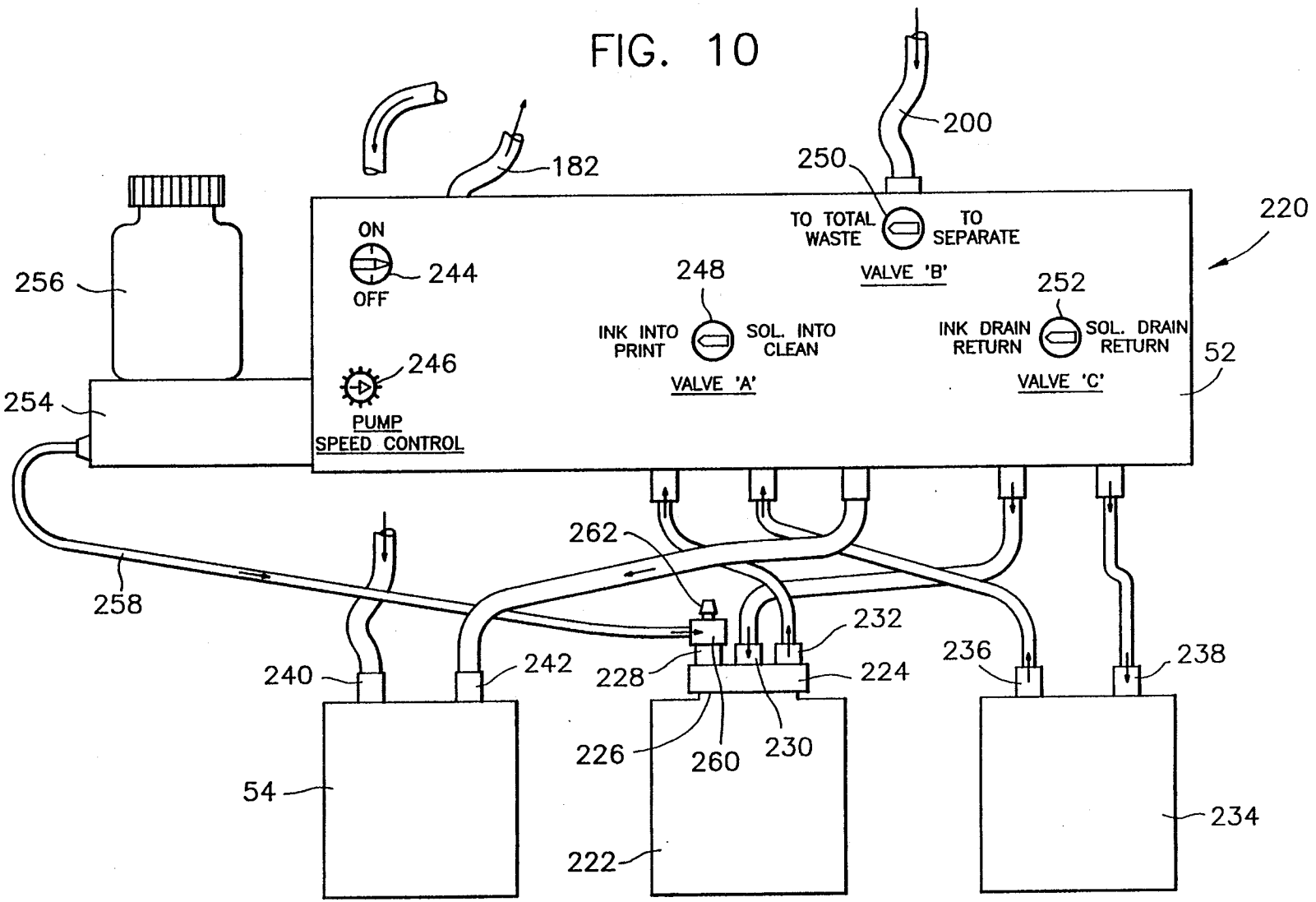
FIG. 10 is a front view of an ink management system and control box.

In FIG. 10, ink management system 220 is shown. The system includes an ink cartridge 222 which includes a predetermined amount of a desired type of ink. The canister includes a cap 224 which is fitted over the neck 226 of the canister 222. The cap 224 includes three ports 228, 230, 232. A solvent canister 234 includes two ports 236, 238. Total waste canister 54 includes two ports 240 and 242.

A control panel 52 includes an on/off switch 244, a pump speed control dial 246, a valve "A" 248 shiftable between an "INK IN TO PRINT" and "SOLVENT IN TO CLEAN" positions, a valve "B" 250 positionable between a "TO TOTAL WASTE" and "TO SEPARATE" positions and a valve "C" 252 positionable between an "INK DRAIN RETURN" and a "SOLVENT DRAIN RETURN" position. To one side of the control panel 52 is a bottle holder 254 on top of which is mounted an ink adjuster bottle 256 or viscosity adjuster bottle which is used as a pH adjuster, fed by gravity into the bottle holder 254 and through $\frac{1}{4}''$ diameter hose 258 to drip feeder adjuster 260 mounted on top of port 228 of the ink cartridge canister 222. A rotatable knob 262 controls the speed of drips into the ink cartridge canister 222 to adjust the pH or viscosity of ink in the canister. The speed of the drip of ink adjuster into the ink canister is based upon a measurement of the pH of the ink being used.

Infeed hose 182 and total drain hose 200 are shown in FIG. 10 and are understood to be connected to the similarly numbered hoses from FIG. 8 which are connected to the fountain 106.

Figure 11:
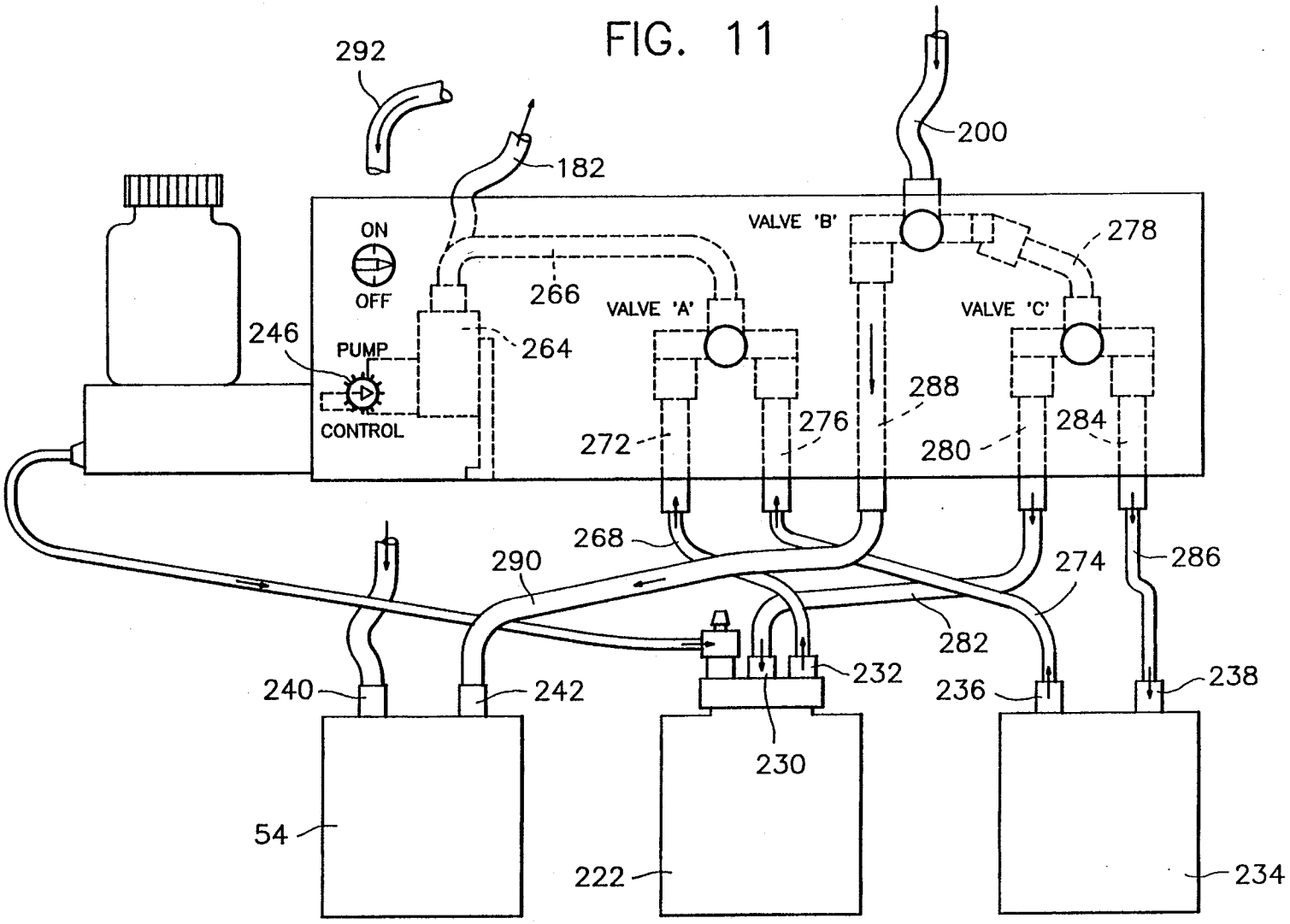
FIG. 11 illustrates the ink management system of FIG. 10 with the cover of the control box removed.

With reference to FIG. 11, the contents of the control box 52 are shown in dotted lines. The pump 264 is shown being connected to pump speed control dial 246 for varying the speed of the pump. The pump includes inlet hose 266 connected to valve "A". According to the position of valve "A", ink may pass into hose 266 by connection of a hose 268 from outlet port 232 of ink canister 222 by way of "ink in" tube 272 (numbered port 1). Alternately, hose 266 is fed from valve "A" with solvent from hose 274 connected to port 236 of canister 234 by "solution in" hose 276 (numbered port 2). Depending upon the position of valve "A", ink or solvent is delivered to infeed hose 182 to the side of ink fountain 106.

During the printing operation, ink is recycled from fountain 106 back to ink canister 222 from line 200 as fed by hose 190 when valve "B" is positioned so that ink passes through $\frac{1}{2}''$ diameter hose 278 to valve "C" which is positioned to connect "ink drain" 280 (numbered port 3) to $\frac{3}{8}$ diameter hose 282 for return of ink to ink canister 222 through port 230.

When valve "A" 248 is positioned for solvent to be run through the printing system, solvent can be returned to the solvent canister 234 through solution solvent drain 284 (numbered port 4) through $\frac{3}{8}''$ diameter hose 286 to port 238. Alternately, if ink mixed with solvent or other solvent is to be disposed of, valve "B" is turned to connect total waste line 288 by hose 290 to port 242 connected to total waste canister 54. Canisters 54 and 234 may be a cardboard box with a collapsible bag contained therein which expands upon introduction of a liquid. Optionally, another port may be positioned in fountain 106 adjacent to the top of the fountain and connected to the fountain by hose 292 as an emergency overflow from the fountain which is in communication with port 240 of waste canister 54.

With respect to FIGS. 8–11, the operation of the ink management system is initiated by the following steps:

1. An ink cartridge canister 222 is connected to the system by removing the shipping cap and replacing it with a special pump cap 224 that has three ports for connection of three hoses. The ink cartridge is shook before removing the cap. The pump cap is installed by pushing it straight down onto the cartridge container until it snaps into place.

2. A solvent bag canister 234 and waste container 54 are connected to the appropriate hoses.

3. Valve "A" is turned to the left to "INK IN".

4. Valve "C" is turned to the left to "INK DRAIN".

5. Valve "B" is turned to the right "TO SEPARATE". If the system was not thoroughly cleaned after prior operation it is necessary to turn valve "B" to "TOTAL WASTE OUT" (to the right) for 30 seconds to clean out old ink and solvents.

6. Pump 264 is set to $\frac{3}{4}$ speed by pump speed control dial 246.

7. The printing system is turned to automatic. This will start turning the fountain roll and anilox roll without ink in the system.

8. The pump is turned on by switch 244.

9. Within 30 seconds ink is pumped to circulate through the ink system.

10. The lower set of adjusting knobs 138 are slowly turned counter-clockwise to squeeze the fountain and anilox rolls to meter the ink onto the anilox roll. The anilox roll is metered properly when the engraving on the roll can be seen through the ink and a bead of ink has formed on both ends of the roll.

Once the system is ready to print, registration must be set using the registration roll 102. The adjustment handle and lock are located on the operator side of the printer. After several printed packages have been through the sealing dies, it is determined if the print should be moved forward or backwards. The press is stopped, the registration roll lock is loosened and the registration roll 102 adjusted forward or backward in groove 101. The registration roll is then locked down. Each one inch of roll adjustment is equal to two inches of print movement. The system is cycled to determine registration is correct.

When it is time to shut down the printer for the night, or any other long period of time, it is necessary to clean all ink out of the system. This is done quickly and easily with the ink management system. With reference to FIGS. 10 and 11, the following procedure is followed:

1. Valve "A" is turned to the right to "SOLVENT IN TO CLEAN".
2. Valve "C" is turned to the right to "SOLVENT DRAIN".
3. Wait 45 seconds or until all the ink in the system has been replaced with solvent.
4. The packaging machine is cycled several times to clean the printing plate with solvent and blot the plate with the web by "printing" with the solvent.
5. The anilox roll 104 is backed away from the plate cylinder 80 by turning the upper set of adjusting knobs 136 clockwise.
6. The pump 264 is shut off.
7. The fountain roll 108 is backed off the anilox roll by turning the lower set of adjusting knobs clockwise 138.

The printing plate 86 and carrier plate 140 may be left on the print cylinder 80 or removed and stored. If it is to be removed, the following procedure is followed:

1. The flex print control box knob is turned to the "HAND" position. This will disengage the clutch 136 allowing the plate cylinder 80 to turn freely.
2. The plate cylinder is rotated so that the printing plate locking hooks 158 are accessible and then loosened.
3. The plate cylinder 80 is rotated until the plate 86 can be slid over the locking pins 154 and be removed.

The ink management system of the present invention allows continuous circulation of ink during printing as well as an automatic cleaning of the ink system and print apparatus.

By the present invention, the following elements are adjustable to provide precise control of the printing system:

REGISTRATION ROLL—This is used to locate or register the printed message on the finished package. By loosening and rolling the roll either forward or backwards the print will move. One inch of roll move equals two inches of print move.

ANILOX ROLL—Used to transfer an even amount of ink onto the printing plate, this is adjusted by turning the upper set of adjusting knobs.

FOUNTAIN ROLL—Used to transfer ink from the ink fountain onto the anilox roll, the pressure between the anilox and the fountain rolls will control the amount of ink transferred. The lower set of adjusting knobs is used for this.

IMPRESSION ROLL—Used to support the web as it is printed, this roll moves on and off the web via two air cylinders. It may be necessaryto adjust the move distance to improve the print quality. This is done by turning the air cylinder stop screws found on the end of the housing that holds the air cylinders.

NIP AND PINCH ROLLS—Used to frictionally drive the system, the nip and pinch rolls open and close via two air cylinders. It may be necessary to adjust the move distance if a web that is much thicker or thinner than a previous web is used. This is done by turning the air cylinder stop screws found on the end of the housings that holds the air cylinders.

AIR PRESSURE—40 to 50 PSI is required to power the nip and pinch rolls and impression roll.

TIMER 2—This is an on/off delay timer than controls the timing of the plate cylinder. If the ink dries on the printing plate before printing the web, the on delay is too long. If the plate cylinder does not reset in time, then the off delay is too long.

TIMER 3—This is a one shot timer that controls the time that the impression and nip rolls are in frictional contact with the web.

pH/SOLVENT ADJUSTER DRIP FEEDER—Located on the metal ink cartridge cap, this adjusts the rate than the pH adjuster or solvent drips into the ink. A rate of 1 drip every 10 seconds is initially set and then increased or decreased as needed.

PUMP SPEED CONTROL—This controls the speed that the ink flows through the system. Used at maximum for waterbase inks and ¾ speed for alcohol base inks.

Having described the invention, many modifications thereto will become apparent to those skilled in the art to which it pertains without deviation from the spirit of the invention as defined by the scope of the appended claims.

We claim:

1. A printing system comprising:

a flexographic printer having printing means for imprinting a web, inking means for providing ink to said printing means and drive means for moving said printing means into contact with a web, and said printing means including a print cylinder with a carrier sheet removably mounted on said print cylinder, said carrier sheet including a printing plate and two elongated drive bearers located on opposite sides of said printing plate so that said printing plate and said two elongated drive bearers wear down together at the same rate to maintain print quality with said carrier sheet including said printing plate and said two elongated drive bearers being removable from said print cylinder and being replacable with a new carrier sheet, a leading edge of said two elongated drive bearers extending to a point closer to a leading edge of said carrier sheet than any printing surfaces defined by said printing plate for buffered initial engagement with an impression cylinder by said two elongated drive bearers prior to contact with the web by any printing surfaces defined by said printing plate.

2. A printing system as claimed in claim 1, wherein said printing plate and said drive bearers are separate.

3. A printing system as claimed in claim 1, wherein said printing plate is a photopolymer.

4. A printing system as claimed in claim 1, wherein said carrier sheet includes mounting means cooperating with said print cylinder for removably mounting said carrier sheet on said print cylinder.

5. A printing system as claimed in claim 1, wherein said print cylinder includes a plurality of plates spaced along a print cylinder shaft and having a periphery with a partial circular shape.

6. A printing system as claimed in claim 5, wherein said circular configuration portion includes a curved face plate for support of said carrier sheet.

7. A printing system as claimed in claim 5, wherein said print cylinder is substantially formed of plastic.

8. A printing system as claimed in claim 5, wherein said plates include a second shaft interconnecting said plates and mounted eccentrically on said plates, extending substantially parallel to said print cylinder shaft.

9. A printing system as claimed in claim 1, wherein said print cylinder is frictionally driven during a printing cycle and mechanically driven during an inking cycle.

10. A printing system as claimed in claim 6, wherein said curved face plate extends less than 360° around.

11. A printing system as claimed in claim 10, wherein said curved face plate extends less than 180° around.

* * * * *